US011234543B2

(12) United States Patent
Tsai

(10) Patent No.: US 11,234,543 B2
(45) Date of Patent: Feb. 1, 2022

(54) DRINKING STRAW DEVICE

(71) Applicant: APPLE JU STUDIO INC., Taipei (TW)

(72) Inventor: Chia-Chien Tsai, Taipei (TW)

(73) Assignee: APPLE JU STUDIO INC., Taipei (TW)

( * ) Notice: Subject to any disclaimer, the term of this patent is extended or adjusted under 35 U.S.C. 154(b) by 271 days.

(21) Appl. No.: 16/550,030

(22) Filed: Aug. 23, 2019

(65) Prior Publication Data

US 2020/0069094 A1 Mar. 5, 2020

(30) Foreign Application Priority Data

Aug. 29, 2018 (TW) ..... 107130139
Jun. 28, 2019 (TW) ..... 108122819

(51) Int. Cl.
*A47G 21/18* (2006.01)

(52) U.S. Cl.
CPC ..... *A47G 21/18* (2013.01)

(58) Field of Classification Search
CPC .... A47G 21/18; A47G 21/184; A47G 21/186; A47G 21/189; F16L 9/17; F16L 21/005; H02G 3/0418
See application file for complete search history.

(56) References Cited

U.S. PATENT DOCUMENTS 3,517,702 A * 6/1970 Trimble ..... H02G 3/0481 138/128
2015/0014431 A1 1/2015 Whittaker et al.

FOREIGN PATENT DOCUMENTS

| | | | |
|---|---|---|---|
| CN | 201630883 | U | 11/2010 |
| CN | 202179393 | U | 4/2012 |
| CN | 204394064 | U | 6/2015 |
| CN | 206423934 | U | 8/2017 |
| DE | 20 2018 1 06851 | U1 | 12/2018 |
| JP | 2014-155524 | A | 8/2014 |
| JP | 2018-157889 | A | 10/2018 |
| TW | M570084 | U | 11/2018 |

(Continued)

OTHER PUBLICATIONS

Search Report appended to an Office Action, which was issued to Taiwanese counterpart application No. 108122819 by the TIPO dated Jul. 7, 2020, with an English translation thereof (2 pages).

(Continued)

*Primary Examiner* — Tuongminh N Pham
(74) *Attorney, Agent, or Firm* — Hamre, Schumann, Mueller & Larson, P.C.

(57) ABSTRACT

A drinking straw device includes a molded elastic sheet having a curved base portion, a first bent portion, and a second bent portion. The first and second bent portions are disposed at two opposite sides of the curved base portion to permit an inward surface of the first bent portion to overlap an outward surface of the second bent portion. The first and second bent portions are respectively imparted with an inward biasing force and an outward biasing force so as to bring the inward surface of the first bent portion and the outward surface of the second bent portion into frictional and abutting engagement with each other to thereby allow the molded elastic sheet to constitute a straw tube extending along a tube axis.

5 Claims, 8 Drawing Sheets

(56) References Cited

FOREIGN PATENT DOCUMENTS

| | | |
|---|---|---|
| TW | M573193 U | 1/2019 |
| TW | M579935 U | 7/2019 |

OTHER PUBLICATIONS

The Search Report issued to European counterpart application No. 19194105.3 by the EPO dated Nov. 11, 2019.
Search Report appended to an Office Action, which was issued to Taiwanese counterpart application No. 108122819 by the TIPO dated Sep. 25, 2019, with an English translation thereof.
Search Report appended to an Office Action, which was issued to Taiwanese counterpart application No. 107130139 by the TIPO dated May 13, 2019, with an English translation thereof.

* cited by examiner

DRINKING STRAW DEVICE

CROSS-REFERENCE TO RELATED APPLICATION

This application claims priority from Taiwanese invention patent application No. 107130139, filed on Aug. 29, 2018, and priority from Taiwanese invention patent application No. 108122819, filed on Jun. 28, 2019.

FIELD

The disclosure relates to a drinking straw device, more particularly to a drinking straw device which may be cleaned in an easy way for reuse.

BACKGROUND

In recent years, environmental issues regarding conventional disposable drinking straws have drawn more attention, and various kinds of environmental friendly drinking straws were developed accordingly. Those environmental friendly drinking straws may be made of plastic, metal, glass, paper, bamboo, edible materials, etc., and some of those drinking straws may be cleaned for reuse using, for example, a brush. The inside of the conventional drinking straws may not be well-cleaned.

US 2015/0014431 A1 and JP 2014-155524 A also disclose conventional drinking straws.

SUMMARY

Therefore, an object of the disclosure is to provide a novel drinking straw device which may be well-cleaned for reuse.

According to the disclosure, a drinking straw device includes a molded elastic sheet having a curved base portion, a first bent portion, and a second bent portion. The first and second bent portions are disposed at two opposite sides of the curved base portion to permit an inward surface of the first bent portion to overlap an outward surface of the second bent portion. The first and second bent portions are respectively imparted with an inward biasing force and an outward biasing force so as to bring the inward surface of the first bent portion and the outward surface of the second bent portion into frictional and abutting engagement with each other to thereby allow the molded elastic sheet to constitute a straw tube extending along a tube axis.

BRIEF DESCRIPTION OF THE DRAWINGS

Other features and advantages of the disclosure will become apparent in the following detailed description of the embodiment(s) with reference to the accompanying drawings, in which.

DETAILED DESCRIPTION

Figure 1:
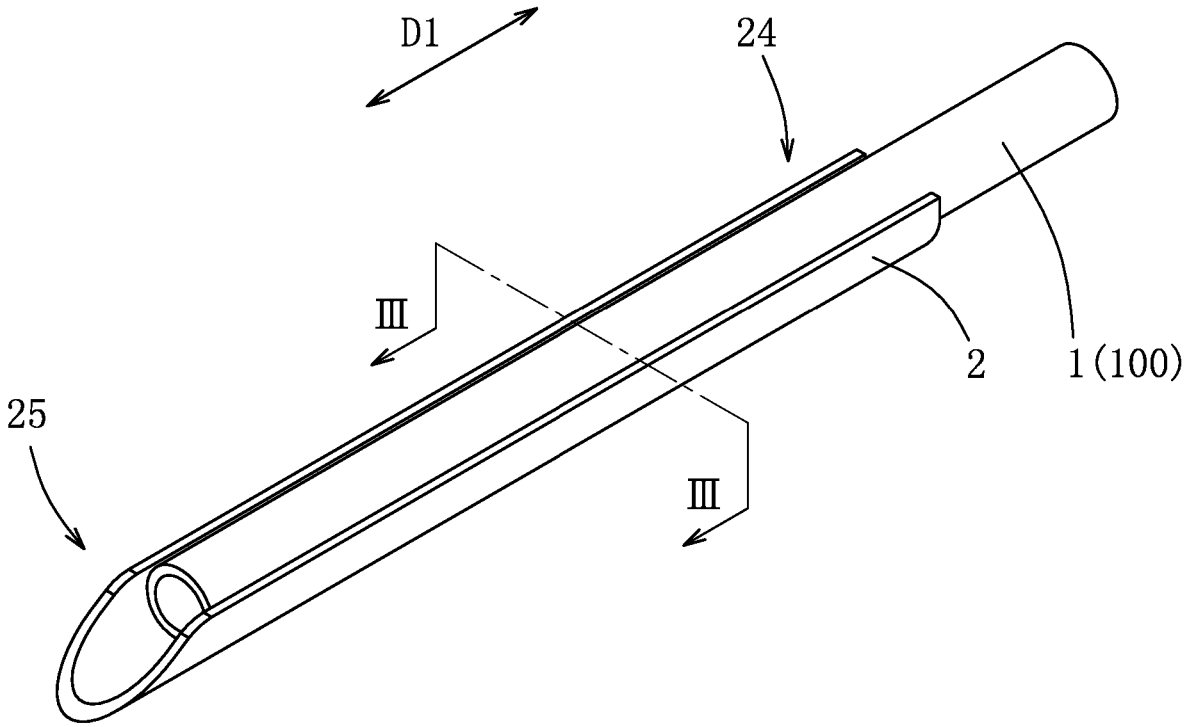
FIG. 1 is a perspective view of a drinking straw device according to an embodiment of the disclosure.

Before the disclosure is described in greater detail, it should be noted that where considered appropriate, reference numerals have been repeated among the figures to indicate corresponding or analogous elements, which may optionally have similar characteristics.

Figure 2:
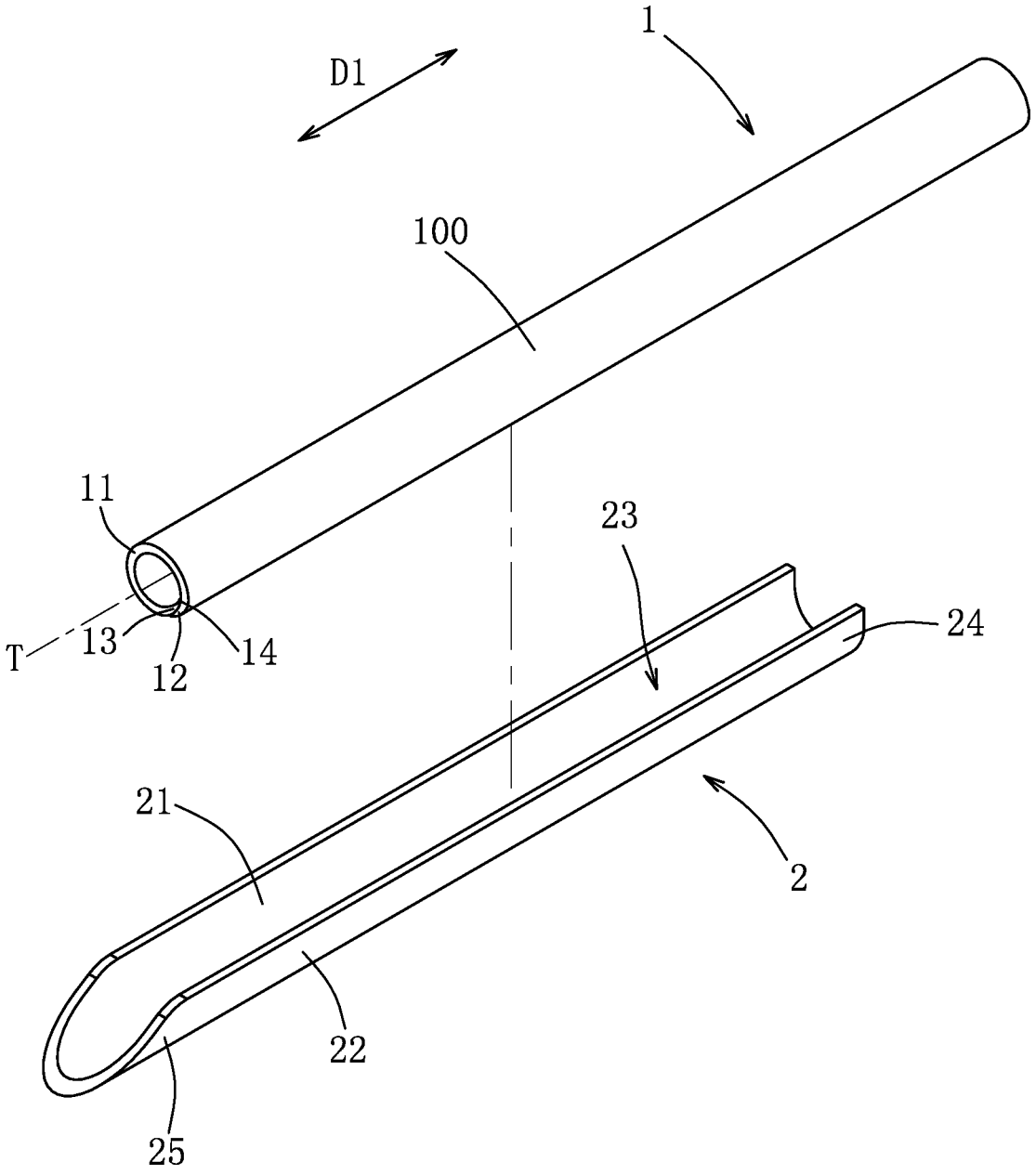
FIG. 2 is an exploded perspective view of FIG. 1.
Figure 3:
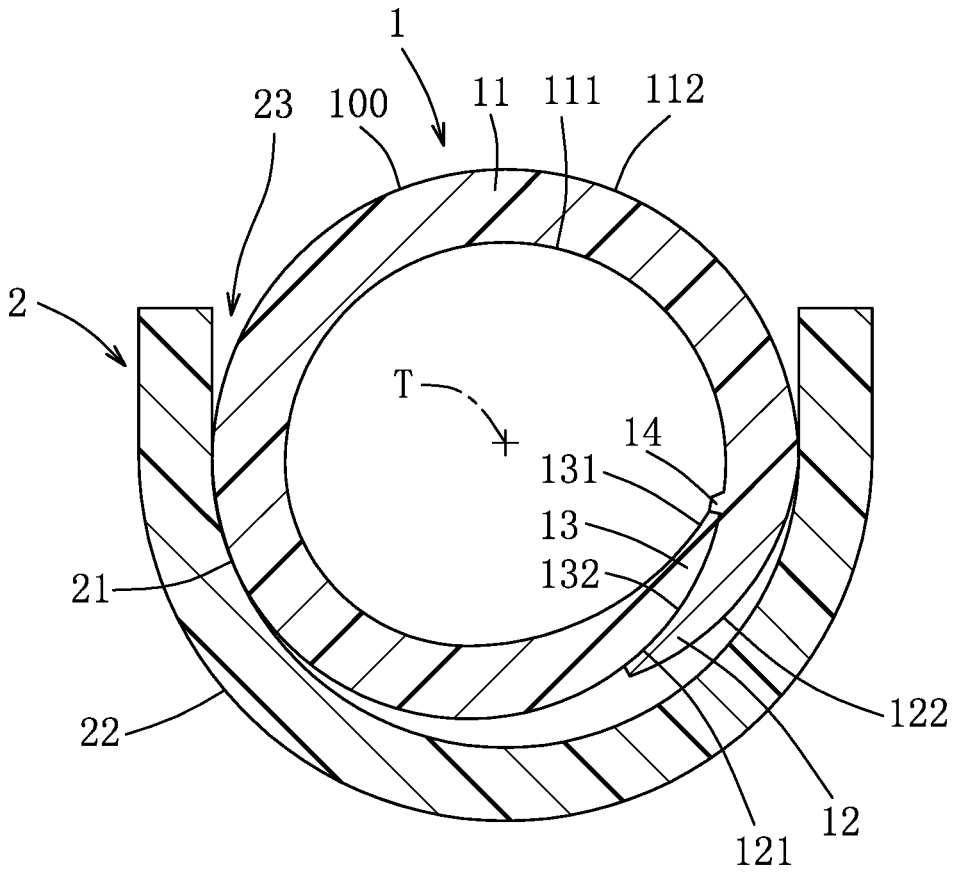
FIG. 3 is a cross-sectional view taken along line of FIG. 1.

Referring to FIGS. 1 to 3, a drinking straw device according to an embodiment of the disclosure is shown to include a molded elastic sheet 100 having a curved base portion 11, a first bent portion 12, and a second bent portion 13. Each of the curved base portion 11 and the first and second bent portions 12, 13 has an inward surface 111, 121, 131 and an outward surface 112, 122, 132. The first and second bent portions 12, 13 are disposed at two opposite sides of the curved base portion 11 to permit the inward surface 121 of the first bent portion 12 to overlap the outward surface 132 of the second bent portion 13. The first and second bent portions 12, 13 are respectively imparted with an inward biasing force and an outward biasing force so as to bring the inward surface 121 of the first bent portion 12 and the outward surface 132 of the second bent portion 13 into frictional and abutting engagement with each other to thereby allow the molded elastic sheet 100 to constitute a straw tube 1 extending along a tube axis (T).

Figure 4:
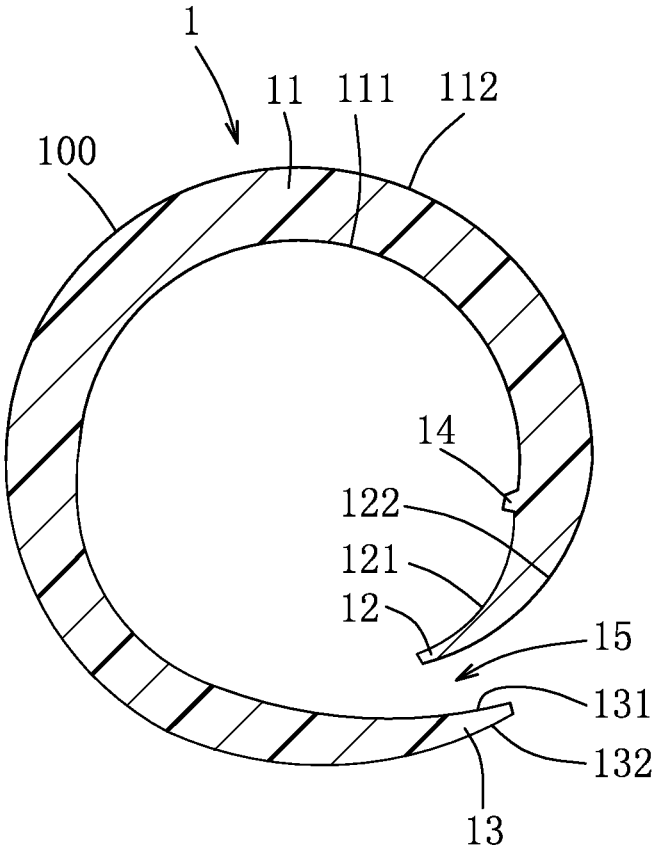
FIG. 4 is a cross-sectional view of a molded elastic sheet, for constituting a straw tube of the drinking straw device, in a natural state.
Figure 5:
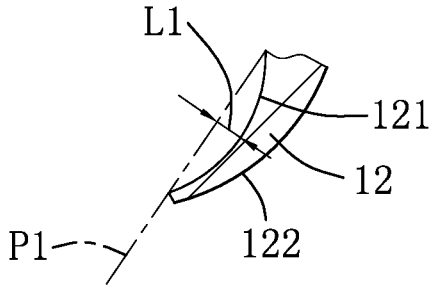
FIG. 5 is an enlarged, fragmentary cross-sectional view illustrating a first bent portion of the molded elastic sheet with a first curvature.
Figure 6:
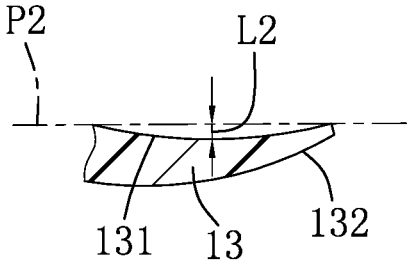
FIG. 6 is an enlarged, fragmentary cross-sectional view illustrating a second bent portion of the molded elastic sheet with a second curvature.

The molded elastic sheet 100 may be transformable between a deformed state and a natural state. As shown in FIG. 3, in the deformed state, the molded elastic sheet 100 constitutes the straw tube 1. As shown in FIG. 4, in the natural state, the second bent portion 13 is disposed radially outwardly of the first bent portion 12 to permit the inward surface 131 of the second bent portion 13 to be spaced apart from the outward surface 122 of the first bent portion 12 by a slit 15. A user may turn the molded plastic sheet 100 inside out from the slit 15 to expose the inward surface 111 of the curved base portion 11. Therefore, the inward surfaces 111, 121, 131 of the curved base portion 11 and the first and second bent portions 12, 13 may be well-cleaned using a cleaning agent and/or a cleaning tool. After cleaning and the user releasing the molded elastic sheet 100, the molded elastic sheet 100 may automatically bend back to the natural state.

The molded elastic sheet 100 may be made of a medical grade thermoplastic material (such as silicone or thermal plastic elastomer) which is susceptible to a relatively high temperature, acid and base. By virtue of a thermoplastic molding process, the thermoplastic material may be processed into the molded elastic sheet 100 in the natural state. As shown in FIGS. 5 to 8, four end points on the inward surface 121 of the first bent portion 12 cooperatively define a reference plane (P1), and four end points on the inward surface 131 of the second bent portion 13 cooperatively define a reference plane (P2). In the natural state shown in FIGS. 4 and 5, the first bent portion 12 has a first curvature, and a first shortest distance (L1) is determined between the reference plane (P1) and a farthest point on the inward surface 121 of the first bent portion 12 away from the reference plane (P1). Furthermore, in the natural state shown in FIGS. 4 and 6, the second bent portion 13 has a second curvature, and a second shortest distance (L2) is determined between the reference plane (P2) and a farthest point on the inward surface 131 of the second bent portion 13 away from the reference plane (P2).

Figure 7:
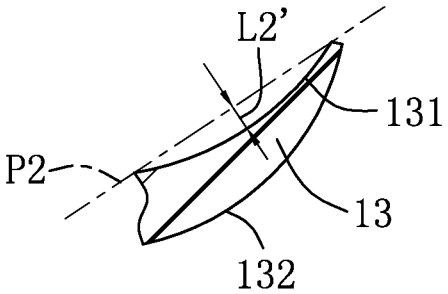
FIG. 7 is similar to FIG. 6, but illustrating the second bent portion with a third curvature.

In the deformed state shown in FIGS. 3 and 7, the second bent portion 13 has a third curvature, and a third shortest distance (L2') is determined between the reference plane (P2) and the farthest point on the inward surface 131 of the second bent portion 13 away from the reference plane (P2) and is larger than the second shortest distance (L2). This means the third curvature is larger than the second curvature (FIG. 6), and the second bent portion 13 in the deformed state is deformed inwardly against its outward biasing force.

Figure 8:
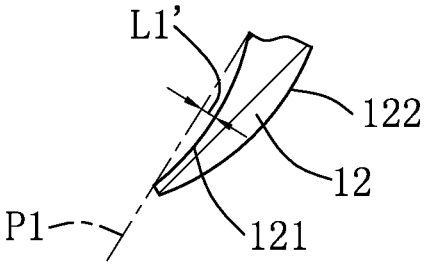
FIG. 8 is similar to FIG. 5 but illustrating the first bent portion with a fourth curvature.

Moreover, in the deformed state shown in FIGS. 3 and 8, the first bent portion 12 has a fourth curvature, and a fourth shortest distance (L1') is determined between the reference plane (P1) and the farthest point on the inward surface 121 of the first bent portion 12 away from the reference plane (P1) and is smaller than the first shortest distance (L1). This means the fourth curvature is smaller than the first curvature (FIG. 5), and the first bent portion 12 in the deformed state is deformed outwardly against its inward biasing force.

The first bent portion 12, which is disposed radially inwardly of the second bent portion 13 in the natural state, is deformed to be disposed radially outwardly of the second bent portion 13 against its inward biasing force in the deformed state. The second bent portion 13, which is disposed radially outwardly of the first bent portion 12 in the natural state, is deformed to be disposed radially inwardly of the first bent portion 12 against its outward biasing force in the deformed state. Therefore, in the deformed state, the first and second bent portions 12, 13 can be brought into frictional and abutting engagement with each other. In addition, because the molded elastic sheet 100 is made of the thermoplastic material which is flexible and may provide a larger frictional force compared to a metal material the molded elastic sheet 100 may be kept at the deformed state by virtue of the frictional force between the first and second bent portions 12, 13. As such, the straw tube 1 is less likely to have an air leak between the first and second bent portions 12, 13 when a user utilizes the straw tube 1 for sucking a drink.

In an embodiment shown in FIG. 2, the first and second bent portions 12, 13 have the same length in a direction (D1) of the tube axis (T). In other non-shown embodiments, the first and second bent portions 12, 13 may have different lengths.

In an embodiment shown in FIGS. 1 and 3, the drinking straw device further includes a stop rib 14 which is formed at an inner juncture between the first bent portion 12 and the curved base portion 11, and which extends in the direction (D1) of the tube axis (T) so as to prevent the second bent portion 13 from overlapping with the curved base portion 11. As such, the straw tube 1 may be kept to have a predetermined inner dimension for sucking up particles (such as, tapioca balls, fibres, pulp, etc.) in a drink.

The stop rib 14 may be integrally formed with the molded elastic sheet 100. In addition, the stop rib 14 may have a length in the direction (D1) substantially the same as that of a free elongated end of the second bent portion 13, and may have a height not less than a thickness of the free elongated end of the second bent portion 13.

In an embodiment shown in FIGS. 1 to 3, the drinking straw device may further includes an elongated member 2 which is made of a material more rigid than that of the molded elastic sheet 100, and which extends along the tube axis (T). The elongated member 2 further extends in a circumferential direction about the tube axis (T) so as to keep and retain the molded elastic sheet 100 in the form of the straw tube 1. Therefore, the elongated member 2 can maintain and reinforce the structure of the straw tube 1.

In an embodiment shown in FIG. 3, the elongated member 2 has a C-shaped or U-shaped cross-section in a direction transverse to the tube axis (T).

In an embodiment shown in FIGS. 1 and 2, the elongated member 2 has a length slightly shorter than that of the straw tube 1, and has an inner surface 21, an outer surface 22, an elongated opening 23, a top end 24, and a beveled bottom end 25. The inner surface 21 defines a groove configured to permit the straw tube 1 to be deformed and fitted thereinto so as to prevent sliding of the straw tube 1 relative to the elongated member 2. The elongated opening 23 extends in the direction (D1) to permit access of the straw tube 1 to the inner surface 21. The top end 24 may be disposed downwardly of a top end of the straw tube 1. The beveled bottom end 25 may be disposed downwardly of a bottom end of the straw tube 1 for penetrating a sealing film of a drink container. The elongated member 2 may also serve as a tool to scoop, pierce, carry, or mix particles inside a drink. A total length of the drinking straw device may be changed by adjusting a relation position between the straw tube 1 and the elongated member 2.

In an embodiment, based on safety concerns, the elongated member 2 may be made of a non-metallic material, for example, a medical grade non-flexible plastic material which is susceptible to a relatively high temperature, acid and base.

In other non-shown embodiments, the elongated member 2 may includes a plurality of non-flexible segments and a plurality of flexible segments disposed to alternate with the non-flexible segments. The top end 24 and the beveled bottom end 25 are respective in top and bottom ones of the non-flexible segments. Therefore, the drinking straw device may have some flexibility, and the elongated member 2 may be folded for easy storage.

Figure 9:
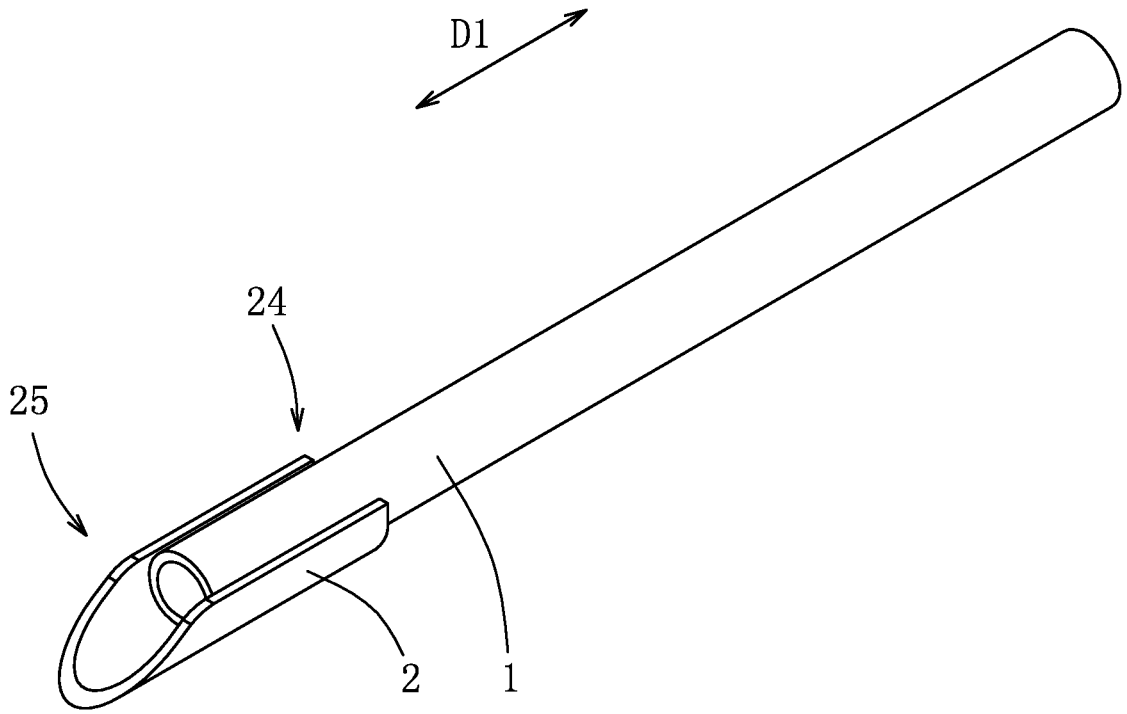
FIG. 9 is a perspective view illustrating a modified embodiment of the drinking straw device.
Figure 10:
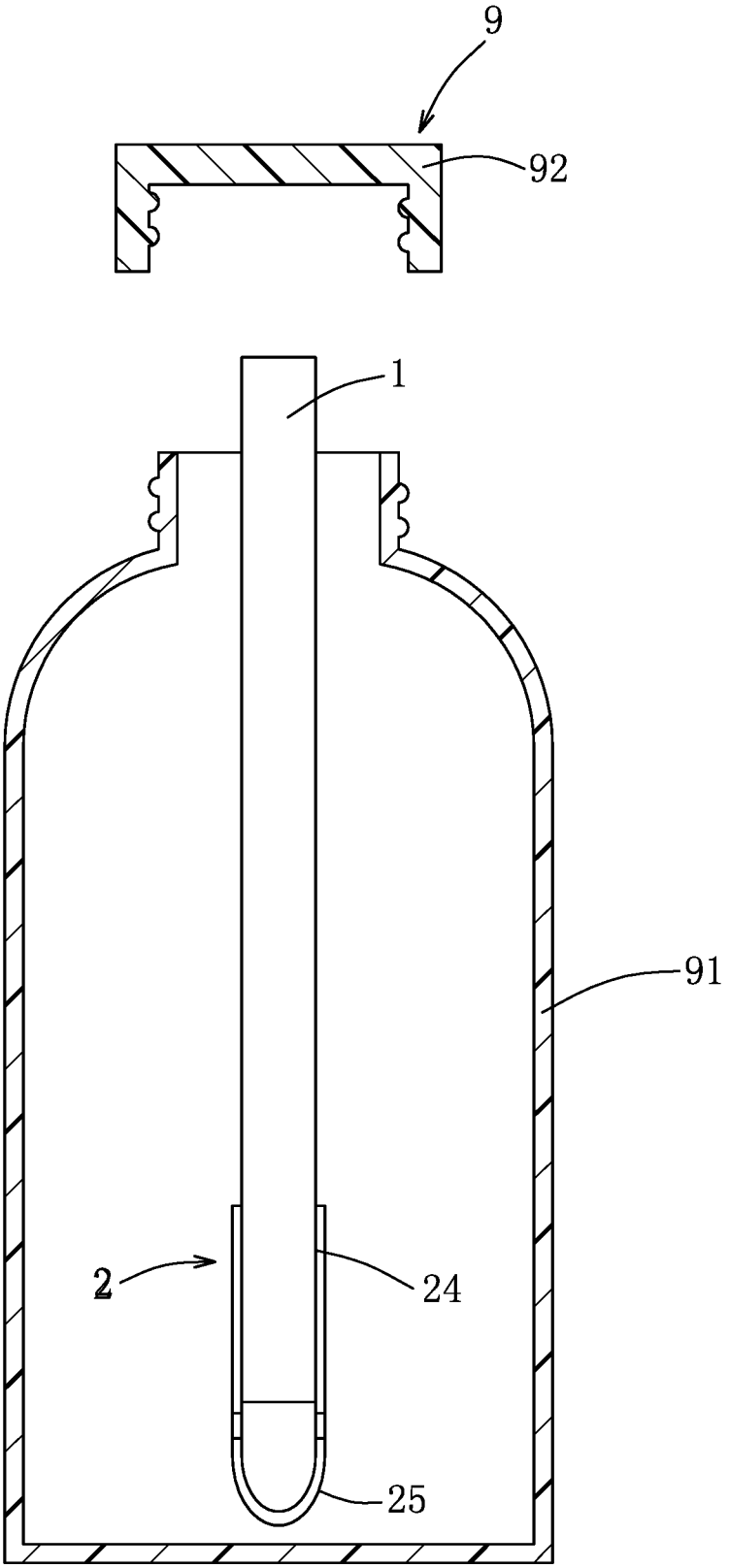
FIGS. 10 and 11 are partially cross-sectional views illustrating the modified embodiment in use with a drinking bottle.
Figure 11:
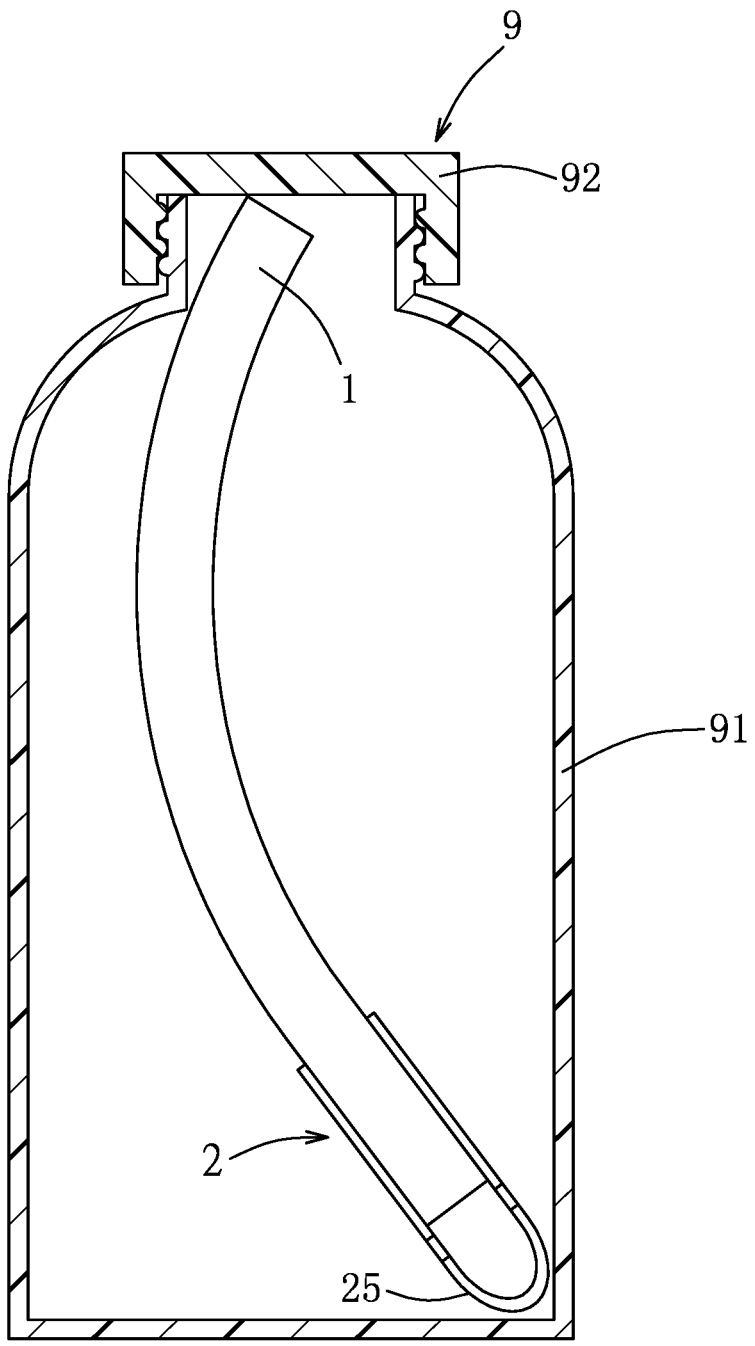

FIG. 9 illustrates a modified embodiment of the drinking straw device in which the elongated member 2 is much shorter than the straw tube 1. FIGS. 10 and 11 illustrates the modified embodiment being used for a drinking bottle 9 which includes a bottle body 91 and a cap 92. Generally, the drinking straw device may have a length larger than a height of the bottle body 91 for sucking the drink at the bottom of the bottle body 91. When the cap 92 is opened as shown in FIG. 10, the top end of the straw tube 1 may extend out of a drinking port of the bottle body 91 for drinking. When the cap 92 is closed as shown in FIG. 11, the straw tube 1 may be deformed to be received inside the drinking bottle 9.

In the description above, for the purposes of explanation, numerous specific details have been set forth in order to provide a thorough understanding of the embodiment(s). It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what is (are) considered the exemplary embodiment(s), it is understood that this disclosure is not limited to the disclosed embodiment(s) but is intended to cover various arrangements included within the spirit and scope of the broadest interpretation so as to encompass all such modifications and equivalent arrangements.

What is claimed is:

1. A drinking straw device comprising:

a molded elastic sheet having a curved base portion, a first bent portion, and a second bent portion, said first and second bent portions being disposed at two opposite sides of said curved base portion to permit an inward surface of said first bent portion to overlap an outward surface of said second bent portion, said first and second bent portions being respectively imparted with an inward biasing force and an outward biasing force so as to bring said inward surface of said first bent portion and said outward surface of said second bent portion into frictional and abutting engagement with each other to thereby allow said molded elastic sheet to constitute a straw tube extending along a tube axis; and an elongated member which is made of a material more rigid than that of said molded elastic sheet, and which extends along the tube axis, said elongated member further extending in a circumferential direction about the tube axis so as to keep and retain said molded elastic sheet in the form of said straw tube, wherein said elongated member has a beveled bottom end disposed downwardly of a bottom end of said straw tube.

2. The drinking straw device according to claim 1, further comprising a stop rib which is formed at an inner juncture between said first bent portion and said curved base portion, and which extends in a direction of the tube axis so as to prevent said second bent portion from overlapping with said curved base portion.

3. The drinking straw device according to claim 1, wherein said elongated member is made of a non-metallic material.

4. The drinking straw device according to claim 1, wherein said elongated member has a C-shaped or U-shaped cross-section in a direction transverse to the tube axis.

5. The drinking straw device according to claim 1, wherein said molded elastic sheet is transformable between a deformed state, where said molded elastic sheet constitutes said straw tube, and a natural state, where said second bent portion is disposed radially outwardly of said first bent portion to permit an inward surface of said second bent portion to be spaced apart from an outward surface of said first bent portion by a slit.

* * * * *